US006772463B2

(12) United States Patent
Gladney et al.

(10) Patent No.: US 6,772,463 B2
(45) Date of Patent: Aug. 10, 2004

(54) PERIMETER STIFFENING SYSTEM FOR A FOAM MATTRESS

(75) Inventors: Rick Gladney, Fairburn, GA (US); Kevin Damewood, Roswell, GA (US)

(73) Assignee: Dreamwell Ltd., Las Vegas, NV (US)

( * ) Notice: Subject to any disclaimer, the term of this patent is extended or adjusted under 35 U.S.C. 154(b) by 0 days.

(21) Appl. No.: 10/102,276

(22) Filed: Mar. 20, 2002

(65) Prior Publication Data

US 2003/0177585 A1 Sep. 25, 2003

(51) Int. Cl.[7] ..... A47C 27/05; A47C 23/04
(52) U.S. Cl. ..... 5/739; 5/716; 5/717; 5/720
(58) Field of Search ..... 5/739, 716, 717, 5/718, 720, 655.7, 655.8

(56) References Cited

U.S. PATENT DOCUMENTS 3,166,768 A * 1/1965 Cunningham ..... 5/718
4,389,743 A * 6/1983 Callaway ..... 5/739 X
4,907,309 A * 3/1990 Breckle ..... 5/720
5,048,167 A * 9/1991 Heffley et al. ..... 29/91.1
5,107,558 A 4/1992 Lück
5,127,635 A * 7/1992 Long et al. ..... 267/91
5,239,715 A * 8/1993 Wagner ..... 5/717
5,467,488 A * 11/1995 Wagner ..... 5/716
5,469,590 A * 11/1995 Simon ..... 5/721
5,537,699 A * 7/1996 Bonaddio et al. ..... 5/739
5,557,813 A 9/1996 Steed et al.
5,669,094 A 9/1997 Swanson
5,687,439 A * 11/1997 Wagner ..... 5/717
5,701,623 A 12/1997 May
5,745,940 A 5/1998 Roberts et al.
5,832,551 A * 11/1998 Wagner ..... 5/718
5,953,778 A * 9/1999 Hiatt ..... 5/716
5,987,668 A * 11/1999 Ackley ..... 5/500
6,088,857 A * 7/2000 Ogle ..... 5/722
6,098,224 A 8/2000 Gladney
6,154,908 A 12/2000 Wells
6,158,071 A 12/2000 Wells
6,202,238 B1 3/2001 Mossbeck et al.
6,223,370 B1 5/2001 Kluft
6,223,371 B1 5/2001 Antinori et al.
6,243,894 B1 6/2001 Kosumsuppamala et al.
6,249,924 B1 * 6/2001 Kluft ..... 5/739 X
6,295,674 B1 10/2001 Smith-McKelvey et al.
6,295,676 B1 10/2001 Warner
6,353,952 B1 * 3/2002 Wells ..... 5/716
6,484,338 B1 * 11/2002 Hagglund ..... 5/716
2001/0029632 A1 10/2001 Parvin
2002/0078509 A1 * 6/2002 Williams ..... 5/716
2003/0177585 A1 * 9/2003 Gladley et al. ..... 5/739
2003/0182729 A1 * 10/2003 Williams ..... 5/718
2003/0229943 A1 * 12/2003 Lewis ..... 5/716

* cited by examiner

*Primary Examiner*—Robert G. Santos
(74) *Attorney, Agent, or Firm*—Ropes & Gray, LLP

(57) ABSTRACT

A stiffening system for the perimeter edges of a foam core mattress comprising a coil spring (or other spring-based) structure disposed along one or more perimeter edges (e.g., one or both side edges, the foot, the head, or a combinations thereof including the foot and both side edges) of a mattress having a foam sleeping area. The perimeter spring structure is rectangular or square in cross-section and provides sufficient stiffness for comfortable seating on the edges of the mattress and is joined to the foam core by planar fabric elements that span the joint between them and are attached to both. The sleep area provides the softness and other salutary effects of a foam sleeping surface while the stiffer spring perimeter element provides the rigidity need for comfortable seating and wear resistance.

12 Claims, 4 Drawing Sheets

PERIMETER STIFFENING SYSTEM FOR A FOAM MATTRESS

BACKGROUND OF THE INVENTION

1. Field of the Invention

This invention relates to bedding products (including but not limited to mattresses) and in particular to edge support systems used to stiffen the perimeter of a bedding product.

2. Description of the Related Art

A traditional bedding or seating product has an inner spring core comprising a plurality of identically configured coil springs arranged in linear columns and rows. If such a spring core is used in a bedding product, the spring core is covered with a mattress pad or covering materials and an upholstered covering surrounds and encases the spring core and mattress pad. Sometimes, an additional padding layer, known as a "topper" is attached to the top sleeping surface. The topper may also be attached to the bottom sleeping surface as well, so that the mattress can be flipped.

Traditional bedding or seating products typically have one degree of firmness throughout because all of the springs of the spring core are identical.

Alternatively, bedding and seating systems may have a resilient foam core. This foam core may be surrounded by perimeter bolsters, located around the edges of the sleeping surface, i.e., at the head, foot, or sides of the mattress as those terms are known in the art. Foam core mattresses may also include toppers, in addition to mattress pads and covers.

Also known in the art are bedding or seating products that have increased firmness about their perimeter edge portions, primarily to prevent collapse of the side edges of the bedding or seating product when a person sits on the side edges. The well-known border wires found in almost all mattresses and seating products are one such device. These edge reinforcements also prevent loss of resiliency of the perimeter edge of the bedding or seating product as a result of persons repeated getting on and off the product or by sitting or leaning on one edge of the bedding or seating product.

Most of these edge supports enhances the firmness by locating firmness enhancing materials or devices between the upper and lower border wires of the product. This limits the effectiveness of the edge support and subjects the border wires to excessive bending forces.

What is needed is an edge support for a bedding or seating product which enhances the firmness of the edge of the product while preventing the border wire from being repeatedly flexed and possibly permanently bent due to a user sitting on the edge of the bedding or seating product.

SUMMARY

A stiffening system for the perimeter edges of a foam core mattress comprising a coil spring (or other spring-based) structure disposed along one or more perimeter edges (e.g., one or both side edges, the foot, the head, or a combinations thereof including the foot and both side edges) of a mattress having a foam sleeping area. The perimeter spring-based structure is rectangular or square in cross-section and provides sufficient stiffness for comfortable seating on the edges of the mattress, while the sleep area defined within the perimeter spring structure provides the softness and other salutary effects of a foam sleeping surface.

BRIEF DESCRIPTION OF THE DRAWINGS

The present disclosure may be better understood and its numerous features and advantages made apparent to those skilled in the art by referencing the accompanying drawings.

The use of the same reference symbols in different drawings indicates similar or identical items.

DETAILED DESCRIPTION

Figure 1:
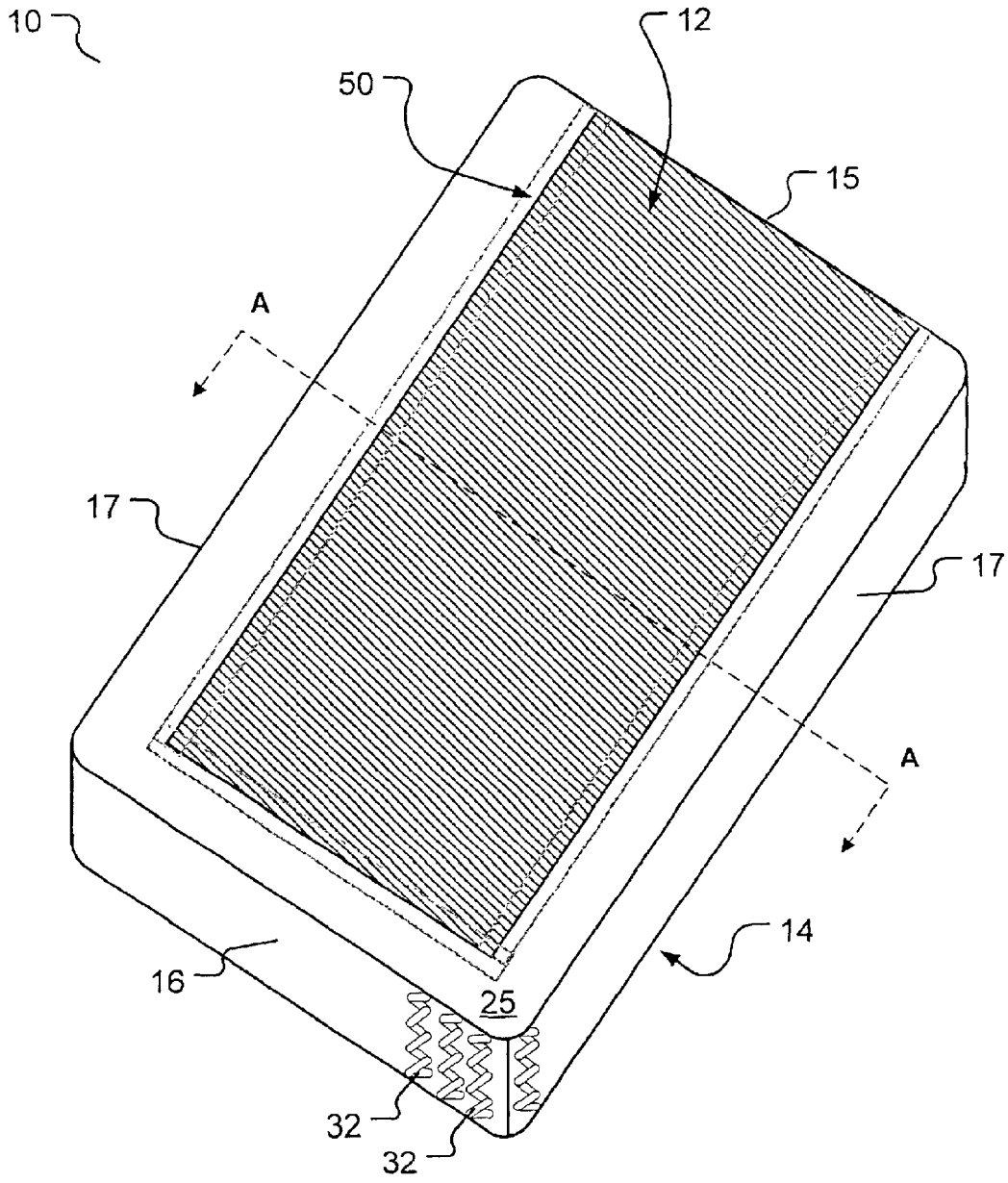
FIG. 1 is an isometric view of a bedding product according to one embodiment of the invention.

FIG. 1 illustrates, in an isometric view, a bedding product generally and in particular a mattress 10 manufactured according to one embodiment of this invention. Mattress 10 consists of a top sleeping surface 12, a bottom sleeping surface 14, a head 15, a foot 16, and two side edges 17. Top sleeping surface 12 and bottom sleeping surface 14 may include within them, or have attached to them, a topper (not shown). The topper may contain one of more layers of fabric, batting, ticking, foam, and/or coiled springs. When present, the foam layer(s) of the topper may include latex and/or synthetic foam, including but not limited to polyurethane foam.

Although omitted for clarity, the topper may be either permanently or removably attached to sleeping surface 12 and 14. Examples of permanently attached topper, seen in the art, are those that are sewn or bonded onto the mattress cover or those that are encased within a sealed pocket in the mattress cover, yet disposed on the surface of the mattress. Removable toppers are typically attached with a temporary fastener, such as a zipper or hook-and-loop fastener in one or more locations. Either attachment method may be used, or no topper may be supplied.

Mattress 10 also includes foam core 20 and perimeter element 25. Foam core 20 is, in some embodiments, a single, monolithic block of a single type of resilient foam selected from foams having a range of densities (themselves well-known in the art) for supporting one or more occupants during sleep. In one embodiment, foam core 20 is made of any industry-standard natural and/or synthetic foams, such as (but not limited to) latex, polyurethane, or other foam products commonly known and used in the bedding and seating arts having a density of 1.9 and a 22 ILD (also known as "192 foam"). Although a specific foam composition is described, those skilled in the art will realize that foam compositions other than one having this specific density and ILD can be used. For example, foams of various types, densities, and ILDs may be desirable in order to provide a range of comfort parameters to the buyer.

In an alternative embodiment, foam core 20 may comprise one or more horizontal layers of multiple types of foams arranged in a sandwich arrangement. This sandwich of different foams, laminated together, may be substituted for a homogeneous foam block of a single density and/or ILD. Accordingly, the invention is not limited to any particular type of foam density or ILD or even to a homogenous density/ILD throughout foam core 20.

In a further embodiment, foam core 20 may comprise one or more vertical regions of different foam compositions (including vertical regions having multiple horizontal layers), where the different foams are arranged to provide different amounts of support (also referred to as "firmness" in the art) in different regions of the sleeping surface.

Figure 2:
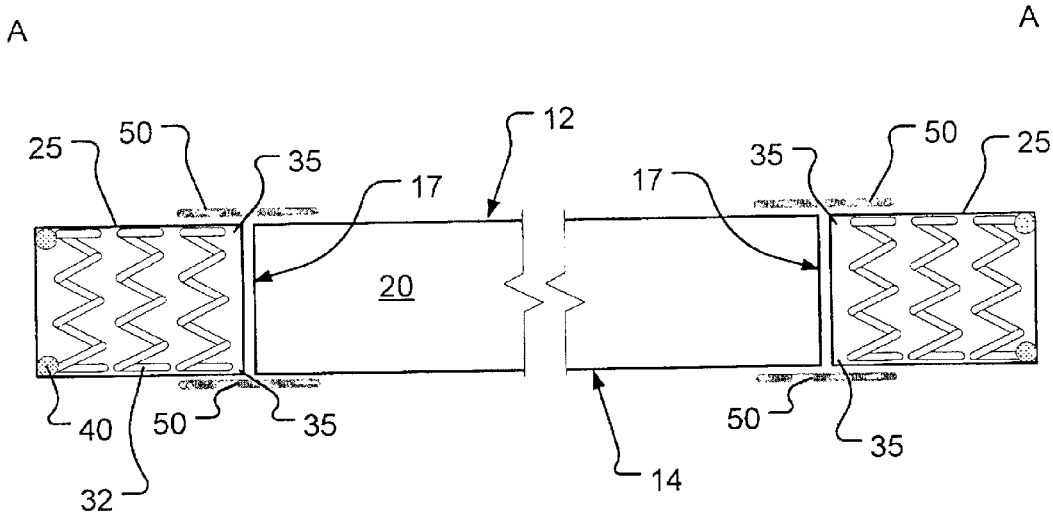
FIG. 2 is a cross-section view at AA of FIG. 1.

Perimeter element 25 is an array of coil springs 32 of substantially the same height as foam core 20 is thick, as shown in FIG. 2. FIG. 2 is a cross-section view at AA of FIG. 1 and illustrates the relative placement of perimeter element 25 abutting side edges 17. The term "perimeter element" is used herein to denote the entire perimeter spring array, whether it abuts one or more than one edge of foam core 20. Accordingly, while FIG. 1 shows a perimeter element 25 that abuts three edges of foam core 20 (to wit, foot 16 and two sides 17), the definition of the term "perimeter element," and the invention in general, are not limited to the configurations illustrated herein.

Springs 32 are of a conventional helical or semi-helical type known and used in the art today. Springs 32 may also be encased in a fabric pocket, either individually, in groups, or pocketed in strings joined by fabric, all of which are well-known in the bedding art.

Note also that the mattress drawn in FIG. 1 is not drawn to scale: the perimeter element 25 is generally about two to six inches wide (measured from the sleeping surface outward to the ultimate edge of the mattress), while the overall mattress dimensions typically fall into the ranges commonly found in the trade and referred to, for example, as Twin, Full, King, Queen, Double, etc.

Returning to FIG. 2, border wires 40 of a type and construction well-known in the art are placed at the outer vertices of perimeter element 25. Alternatively, to supply even more stiffness at the mattress edges, an additional set of border wires 40 may be placed at the inner vertices 35 of perimeter element 25 (see FIG. 3). All of these border wires 40 may be used as attachment points for securing springs 32 within perimeter element 25, as with the clips or metal "hog ring" attachment devices currently known and used in the bedding art today.

Although hog ring or clip attachment means are described, those skilled in the art will realize that attachment devices other than hog rings, such as plastic snap fasteners, locking cable ties, wire twists, lacing, or cord can be used. Accordingly, the invention is not limited to any particular type of attachment means for securing coils 32 to border wires 40.

In some embodiments, border wires 40 may also be omitted, along with the hog ring/clip attachment means in order to reduce cost and/or manufacturing complexity.

Perimeter element 25 and foam core 20 are attached one to the other by planar elements 50. Each planar element 50 is a textile material, including but not limited to a tape or webbing or open-weave material, non-woven fibers, or a coated fabric capable of heat lamination (fusion, i.e., a "fusible fabric") to and with both foam core 20 and perimeter 25. Alternatively, planar elements 50 may be attached by means of gluing, stitching, quilting, riveting, or welding, or by other attachment means currently known or afterwards discovered for attaching fabric-like, planar materials to both foam and metallic elements (i.e., the perimeter element's array of springs), whether or not the perimeter element consists of fabric-pocketed coils and whether or not the perimeter element is encased in a covering.

In one embodiment, planar elements 50 consist of strips of Weblon® or Duon® brand ticking. Duon is a polyethylene or polypropylene fiber (an olefin, generally) manufactured by Phillips Fiber Corp.

Planar elements 50, which may consist of a single piece of material cut or otherwise formed to span all foam core/perimeter element interfaces or multiple strips of material that abut or overlap when they intersect, is typically about three to six inches wide, though the exact width is not critical. (FIG. 1, by way of example and not limitation, shows planar elements 50 as three strips of material overlapping at two intersections.) Planar elements 50 are placed on the sleeping surface of mattress 10 substantially as shown in FIG. 2, roughly centered on the joint formed by the abutting components and overlapping portions of both foam core 20 and perimeter element 25 prior to attachment to both. Alternatively, planar element(s) 50 may be first attached to foam core 20 before the core is brought into abutment with perimeter element 25, in order to aid handling and manufacturing. Such an arrangement creates a foam core with a "flange" of planar element material around it.

Alternate Embodiments

Figure 3:
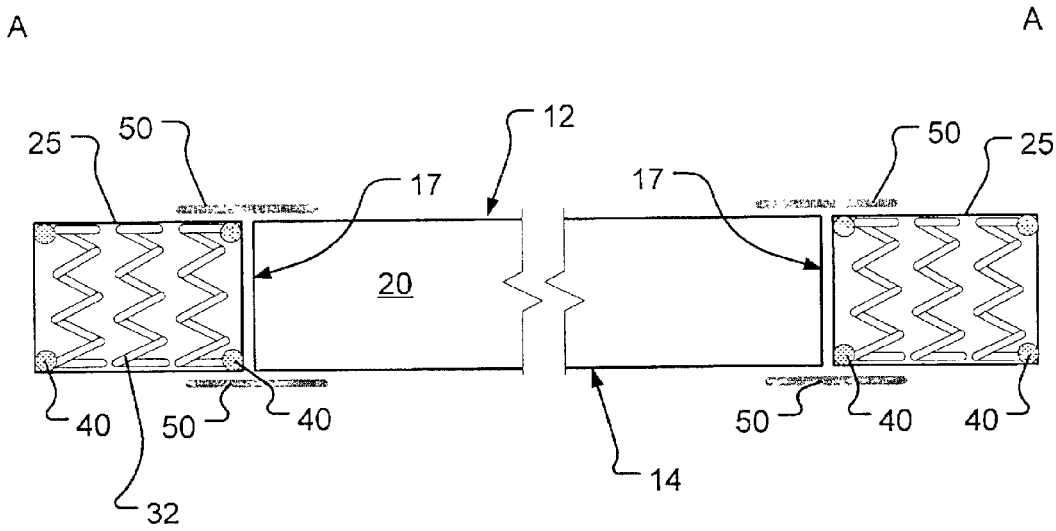
FIG. 3 is an alternate embodiment of the invention, shown in cross-section view at AA.

FIG. 3 is an alternate embodiment of mattress 10, shown in a cross-section view at AA (referring to FIG. 1), illustrating an alternate embodiment having two sets of border wires 40.

In some embodiments, planar elements 50 may be omitted entirely. In these embodiments, a perimeter element 25 consisting of pocketed coils may be glued directly to foam core 20.

Figure 4A:
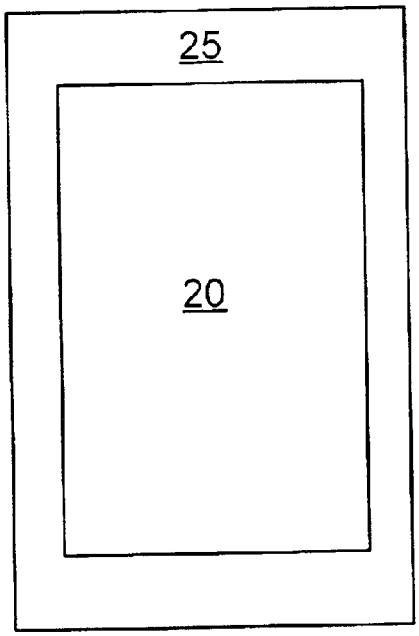
FIGS. 4A, 4B, and 4C are plan views of a bedding product according to several alternate embodiments of the invention.
Figure 4B:
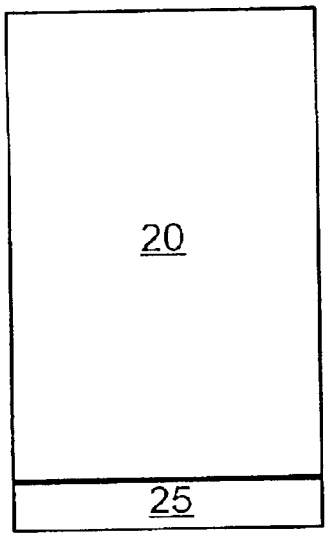
Figure 4C:
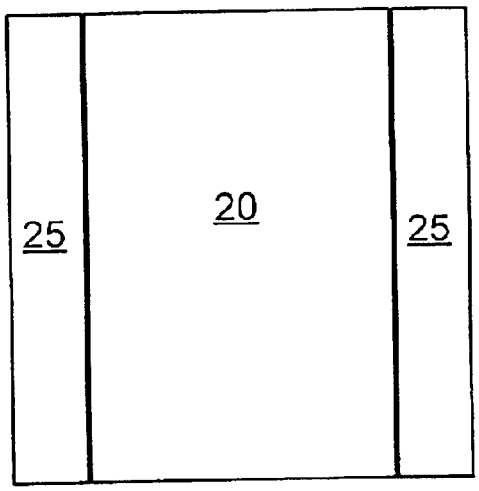

FIG. 4A illustrates, in plan view, a further alternate embodiment of the invention, in which perimeter elements 25 extend around all four sides of foam core 20. Such an embodiment is useful, for example, in bedding products for use without a headboard or footboard or when it is desirable to be able to flip the mattress from head to foot to extend the lifetime of the sleeping surfaces. Other embodiments, in which perimeter element 25 is placed on only one or only two sides or on the head or foot alone, are equally within the scope and spirit of this invention and are shown in FIGS. 4B and 4C.

The order in which the steps of the present method are performed is purely illustrative in nature. In fact, the steps can be performed in any order or in parallel, unless otherwise indicated by the present disclosure.

In particular, as an aid to manufacturing, the planar elements may be first attached to the foam core to form a soft "flange" prior to placing the perimeter elements in abutment with the foam core (or vice-versa). Once abutting, the "flange" (unattached) portion of the planar element can be laminated or otherwise bonded to the perimeter element.

While particular embodiments of the present invention have been shown and described, it will be apparent to those skilled in the art that changes and modifications may be made without departing from this invention in its broader aspect and, therefore, the appended claims are to encompass within their scope all such changes and modifications as fall within the true spirit of this invention.

We claim:

1. A bedding product, comprising:

a generally rectangular foam core having a first height and a perimeter having four sides;

a perimeter element having a second height approximately equal to said first height arranged in abutment with at least one of said perimeter sides of said foam core and comprising a plurality of springs of one or more pocketed springs arranged in an array; and one or more border wires securing said array of springs; said perimeter element being joined to said foam core by one or more planar elements disposed perpendicular to said sides spanning the interface therebetween and secured to both said foam core and said perimeter element.

2. The bedding product of claim 1, further comprising a topper attached to the top surface of said bedding product.

3. The bedding product of claim 2, wherein said topper comprises a latex foam layer.

4. The bedding product of claim 1, wherein said one or more planar elements each comprise a fusible fabric.

5. The bedding product of claim 1, wherein said one or more planar elements each comprise a webbing.

6. The bedding product of claim 1, wherein said foam core comprises a monolithic resilient foam element.

7. A method of manufacturing a bedding product, comprising:

furnishing a generally rectangular foam core having a first height and a perimeter, said perimeter having four sides;

placing a perimeter element in abutment with said foam core on at least one of said four perimeter sides, said perimeter element having a second height approximately equal to said first height and comprising a plurality of springs of one or more pocketed springs arranged in an array with one or more border wires securing said array of springs; and joining said perimeter element to said foam core to form said bedding product, said joining comprising spanning the interface between said perimeter element and said foam core with one or more planar elements disposed perpendicular to said sides and securing each said one or more planar elements to both said foam core and said perimeter element.

8. The method of claim 7, further comprising attaching a topper to the top surface of said bedding product.

9. The method of claim 8, wherein said topper comprises a latex foam layer.

10. The method of claim 7, wherein said one or more planar elements each comprise a fusible fabric.

11. The method of claim 7, wherein said one or more planar elements each comprise a webbing.

12. The method of claim 7, wherein said foam core comprises a monolithic resilient foam element.

* * * * *